United States Patent [19]

Gold

[11] Patent Number: 4,759,449

[45] Date of Patent: Jul. 26, 1988

[54] INTERLOCKING EXPANDABLE BOOKRACK

[76] Inventor: Kenneth S. Gold, 6 Buckskin Ct., Bell Canyon, Calif. 91307

[21] Appl. No.: 83,210

[22] Filed: Aug. 10, 1987

[51] Int. Cl.[4] ..... A47B 65/00

[52] U.S. Cl. ..... 211/43; 211/184

[58] Field of Search ..... 211/43, 11, 184, 42, 211/189; 108/60, 61; 312/108; 248/DIG. 9

[56] References Cited

U.S. PATENT DOCUMENTS

| | | | |
|---|---|---|---|
| 660,264 | 10/1900 | Storm | 211/42 |
| 1,030,279 | 6/1912 | Browne . | |
| 1,506,204 | 8/1924 | Snoddy | 211/43 |
| 2,855,258 | 10/1958 | Moncier | 211/184 X |
| 2,944,678 | 7/1960 | Grantham | 211/194 |
| 3,269,558 | 8/1966 | Hess | 211/184 |
| 3,300,057 | 1/1967 | Wheaton | 211/184 |
| 3,905,484 | 9/1975 | Dean et al. | 211/184 |
| 3,999,663 | 12/1976 | Walter et al. | 248/DIG. 9 X |
| 4,178,047 | 12/1979 | Welch | 312/140 |
| 4,560,072 | 12/1985 | Burrell | 211/131 X |
| 4,595,105 | 6/1986 | Gold | 211/43 |

FOREIGN PATENT DOCUMENTS 2092884 8/1982 United Kingdom .

*Primary Examiner*—J. Franklin Foss
*Assistant Examiner*—Sarah A. Lechok Eley
*Attorney, Agent, or Firm*—J. E. McTaggart

[57] ABSTRACT

For supporting a variety of brochures, magazines, catalogs and other "soft" reading material as well as hardcover books in an upright position, this bookrack may be readily assembled by an unskilled person, without tools or additional fastening hardware, from only two configurations of economically manufactured parts: molded plastic partitions and base/back panels which can be readily extended in multiples by integral edge fastenings as well as individually shortened at scored breakoff lines to obtain a desired total length to permit retrofitting onto existing bookshelves. Keystone-shaped tabs on the partitions interlock with keyed slots in the panels to fasten the panels and partitions together, retained by a simple integral detent system. Panels and partitions are made as thin as practically possible to achieve high space efficiency, and all fastenings are concealed to eliminate obstructions that could interfere with reading material being accommodated in the bookrack.

13 Claims, 2 Drawing Sheets

INTERLOCKING EXPANDABLE BOOKRACK

FIELD OF THE INVENTION

This invention relates to the field of bookracks for supporting various hard-cover books as well as soft-cover books such as magazines, catalogs, brochures and the like, in a vertical position. More particularly, this invention relates to highly space-efficient bookracks which are especially suitable for retrofitting into existing bookshelves, and which provide thin-wall partitions whose spacings may be randomly selected by the user.

BACKGROUND OF THE INVENTION

Holding books in an upright position on bookshelves has been a universal problem over many years. Even conventional hard cover books usually require some degree of support on bookshelves, such as an occasional bookend or partition. However the trend toward a large predominance of soft-cover reading materials such as paper-backs, magazines, brochures, catalogs and the like has created a large unfulfilled need for providing bookshelves with better upright support for a variety of intermixed hard- and soft-cover reading materials, to prevent the well known annoyance and unsightliness of sagging, slumping and crushing of the softer and thinner items.

Approaches addressing this problem in the past have usually proposed equipping the bookshelf with some form of partitions. Some examples of early art employed structure suitable only for incorporation as part of original custom built-in shelving structure, as developed for public buildings such as libraries. Approaches proposed for original manufacture or custom construction have typically provided only fixed partition spacings, wasted an excessive amount of available shelf space due to partition thickness and/or lacked the flexibility and adaptability that would be necessary to render them satisfactory in the problem of retrofitting existing bookshelves as addressed by the present invention.

Wires or rods have sometimes been proposed for partitions, as disclosed in U.S. Pat. Nos. 660,264 to Storm and 1,506,204 to Snoddy, however these are suited primarily to the support of hard-cover books, and are inadequate to support soft-cover items satisfactorily.

Sheet metal or plastic bookcases and "organizers" have become available with thinwall partitions, and some of these may be suitable for soft-cover reading materials, however configurations of this type are known to be available only in pre-assembled form having fixed partition spacings and total width which render them generally inflexible and unadaptable to the individual requirements of upgrading existing bookshelves.

Pre-assembled bookrack structures, when not in actual use, are needlessly bulky, wasteful of storage space and costly to warehouse, pack and ship; therefore it is deemed highly advantageous for the bookrack to be made available as a knocked-down kit of flat parts for on-site assembly.

Many known bookrack configurations, including some in knocked-down kit form, have required considerable skill and use of tools to assemble and install, and even if adaptable to to existing bookshelves, many of these require drilled holes, screw holes or other irreversible and unacceptable disfiguration of the bookshelves.

A concealed interlocking system for fastening partitions to bases and backs is needed, eliminating any moldings, cleats, brackets or other fastenings which would intrude into the book support cells. Fastening means should be integral with the partitions, bases and backs, to avoid the need for additional hardware parts.

Concealed fastenings have been disclosed in U.S. Pat. Nos. 1,030,279 to Browne and 4,178,047 to Welch, and in U.K. Pat. No. 2,092,884 to Osmond, however all three of these approaches require additional specially-tooled metal hardware insert parts, and are applicable only to wooden furniture-type construction with wall thickness in the order of $\frac{3}{4}''$, which would waste an excessive amount of the available shelf space.

An interlocking bookrack of the type addressed by this invention and satisfying most of its general requirements is disclosed in U.S. Pat. No. 4,595,105 to Gold, the present inventor, utilizing 3-layer sheet metal laminated partitions separated and retained by individual formed sheet metal bottom and rear spacers. To provide a selection of partition spacings, the it was necessary to provide the spacers in various widths. As a further development of this approach, the present invention has achieved a significant reduction in the number of different part configurations required, and has simplified fabrication by structuring the parts for molding in plastic.

It is a primary object of the present invention to provide an improved, economically-manufactured bookrack for retrofitting into an existing bookshelf to provide superior support for a variety of reading materials ranging from thin unbound papers to books of various thickness.

It is a further object of this invention to enable the capability of providing the above-described bookrack in the form of a knocked-down kit of flat parts which are convenient and economical to store, pack and ship.

It is a further object to provide interlocking flat parts from which the bookrack may be easily assembled by an unskilled person without requiring tools, fastenings or other additional hardware.

It is a further object to provide standardized parts from which the bookrack may be assembled to virtually any desired length, as required by existing bookcase structure.

It is a further object to provide standardized parts which provide total freedom to select and intermix partition spacings in the assembly of the bookrack.

It is a further object of the present invention to configure standard bookrack parts which may be readily molded from plastic.

It is a further object to accomplish all of the foregoing objects with the minimum possible number of different part configurations as supplied to the user.

It is a further object of this invention to make the bookrack highly space-efficient by making all parts to have thin walls.

It is still a further object to avoid any protrusions or obstructions which could interfere with accomodated reading material, by concealing all partition-fastening means.

These objects have been met in the present invention by the development of a novel system of bookrack parts, requiring only two configurations, from which a wide variety of bookracks may be readily assembled: (1) a standard partition configuration and (2) a versatile panel configuration utilized in both the base and the back, readily capable of both reduction in length and extension to unlimited length requirements. These configurations incorporate novel integral concealed interlocking partition-fastening means and enable a full selection of intermixable partition spacings.

DETAILED DESCRIPTION

Figure 1:
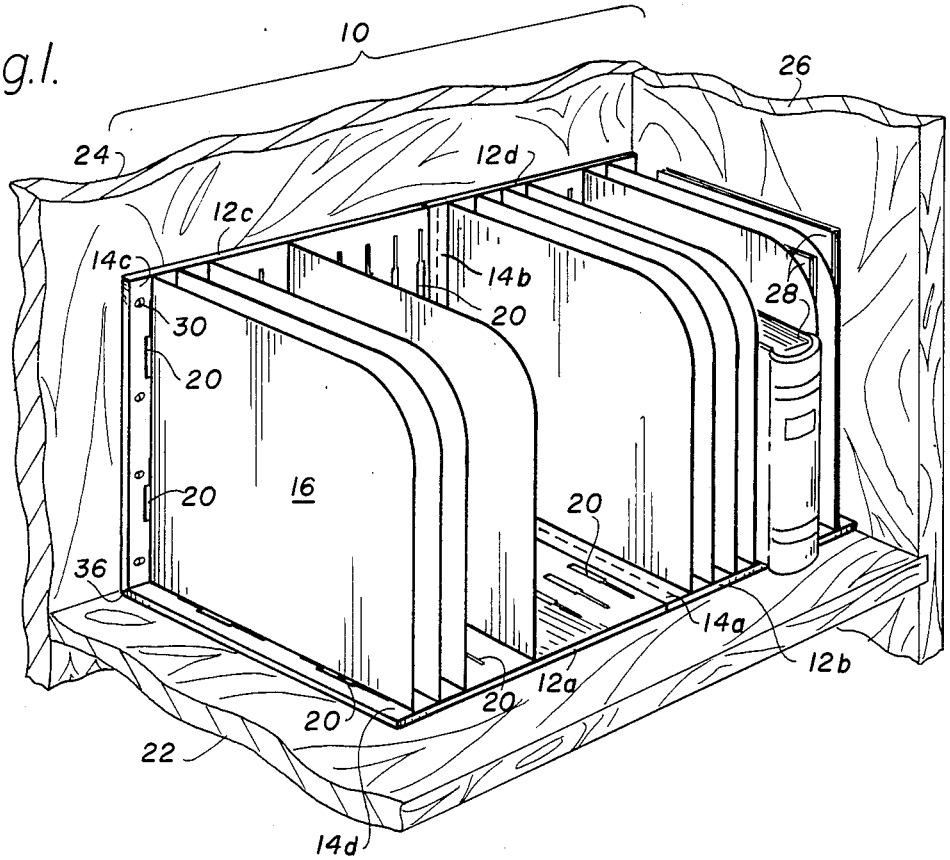
FIG. 1 is a perspective view of a bookrack module configured in accordance with the present invention in an illustrative embodiment, located in a conventional bookshelf.

In the perspective view of FIG. 1, a bookrack in accordance with the present invention in an illustrative embodiment is shown in typical usage in an existing bookcase. Bookrack 10 comprises a base made up from a first panel 12*a* attached to a second panel 12*b* at an overlapping edge strip 14*a* of panel 12*b*. Attached to the base 12*a*/12*b* are a number of partitions 16, of which the one shown in full at the left is typical, attached by concealed retaining tab means on its bottom edge engaging a pair of partially concealed keyed retaining slots 20 provided in host base panel 12*a*. Dividers 16 are in turn attached in the same manner to a back made up from panel 12*c* attached by its overlapping edge strip 14*b* to panel 12*d*. Bookrack 10 is shown nested into a conventional wooden bookcase comprising shelf 22, back 24 and end 26, supporting some typical items of reading material 28 toward the right end of bookrack 10. At its left hand end, extending past partition 16, are seen edge flange 14*d* of base panel 12*a*, identical with edge flange 14*a* of base panel 12*b*, and also edge flange 14*c*, part of back panel 12*c*, provided with four edge-fastening socket holes 30, and forming a corner 36 with base panel 12*a*.

Figure 2:
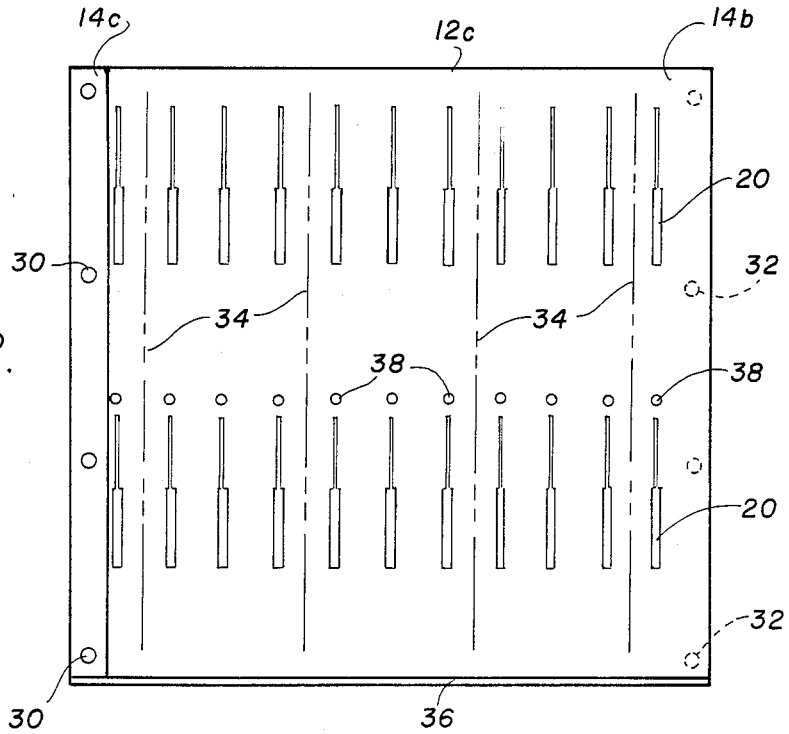
FIG. 2 is a plan view of a typical panel as utilized in the base and back of the bookrack.

FIG. 2 shows a plan view of back panel 12*c* which is typical of both base panels and rear panels. The bottom edge 36 is angled at 45 degrees, while the top edge is made perpendicular. Eleven pairs of retaining slots 20 are arranged in an equally-spaced array as shown, each pair defining a potential partition location. Immediately above the lower slot 20 of each pair is a small locking indentation 38. At the left of FIG. 2, edge strip 14*c* is provided with four edge-fastening socket holes 30, and at the right of FIG. 2, edge strip 14*b* is provided with four hollow edge-fastening plug buttons 32 located on the reverse side of the panel, as indicated by dotted circles. Also shown are four equally spaced breakoff scores 34 located at the positions shown, midway between adjacent slots 20.

Figure 3:
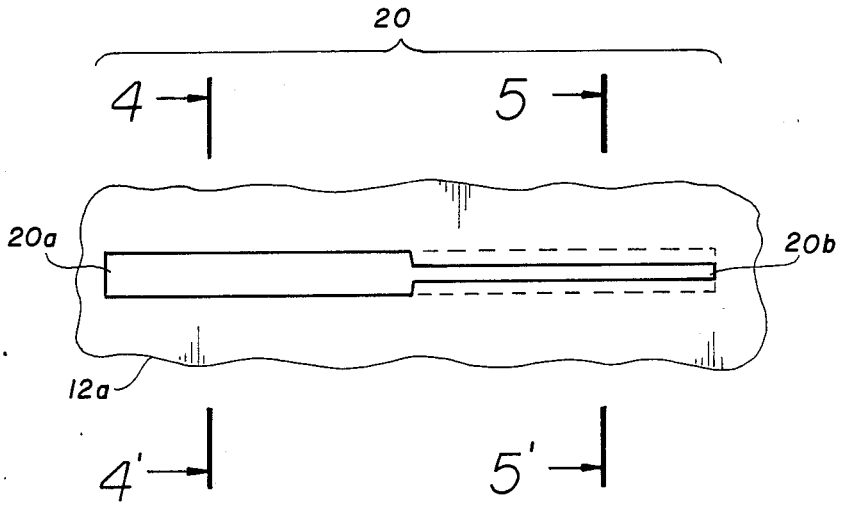
FIG. 3 is a plan view of a typical one of the keyed retaining slots provided in base and back panels.
Figure 4:
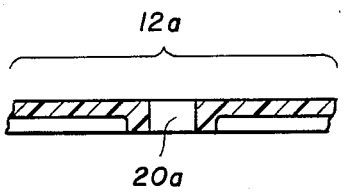
FIG. 4 is a cross-sectional view of the clearance region of a typical keyed retaining slot.
Figure 5:
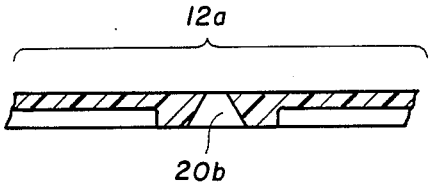
FIG. 5 is a cross-sectional view of the locking region of a typical keyed retaining slot.

FIG. 3 is an enlarged plan view of a portion of a panel, such as base panel 12*a*, containing a typical keyed retaining slot 20 which has a clearance region 20*a* and a locking region 20*b*. The clearance region 20*a*, shown in cross-section in FIG. 4, is seen to have parallel walls, while the locking region 20*b* shown in cross-section in FIG. 5, is seen to be narrower on the top side, with angled walls flaring to increased base width, which is made the same as the width of the clearance region 20*a*. At the junction of the clearance region 20*a* and the locking region 20*b*, the slot walls may be shaped to taper or round off the otherwise abrupt transition from parallel to angled walls.

Figure 6:
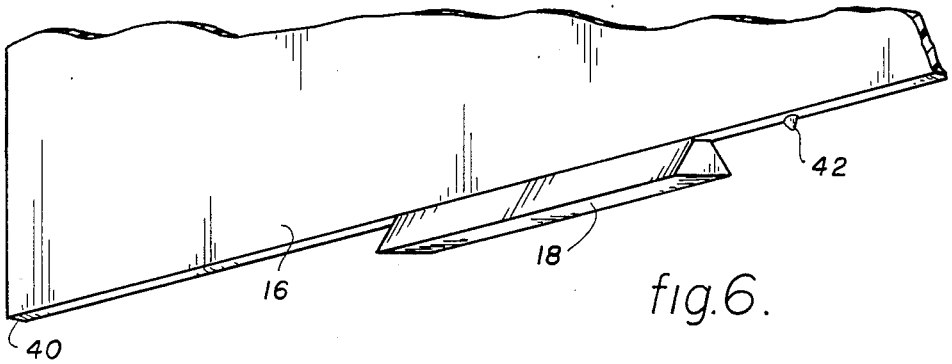
FIG. 6 is a perspective view of the bottom rear corner of a typical partition showing one of the retaining tabs formed on the bottom edge.

FIG. 6 shows an enlarged perspective view of a portion of a partition 16, around the lower rear corner 40, showing a keystone-shaped retaining tab 18 which is the rear one of a pair located along the bottom edge of each partition 16. It will be noted that the shape, dimensions and location of tabs 18 are made to correspond with the keyed retaining slots 20 of FIG. 3 such that the pair of tabs 18 can be inserted into the clearance regions 20*a* of a corresponding pair of slots 20 then moved fully into the locking regions 20*b* by moving the partition 16 toward the front of base panel 12*a*. The front-facing end of tabs 18 may be formed with rounded-off corners to facilitate smooth entry of tab 18 into the locking region 20*b* from the clearance region 20*a*.

Referring to FIG. 6, a small rounded detent pin 42 formed as a hemispherically-shaped integral protrusion on the bottom edge of each partition 16 in front of rear tab 18, is positioned so as to slidingly engage a corresponding detent indention 38 shown in FIG. 2 at each partition location, when tabs 18 have been moved fully into the locking regions 20*b* of slots 20, providing a detent effect for retaining partition 16 in place.

Figure 7:
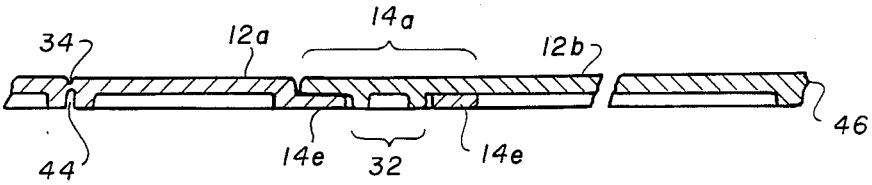
FIG. 7 is a cross-sectional view of a typical overlapping joint between two panels of the bookrack.

FIG. 7, a cross-sectional view of an overlapping joint between two panels, shows a hollow-core plug button 32 on edge flange 14*a* of panel 12*b*, inserted into a mating socket hole in edge flange 14*e* of panel 12*a*, this hole being the same as holes 30 shown in FIG. 1 and FIG. 2, in edge flange 14*c* of panel 12*c*. Buttons 32 and socket holes 30 are made with opposing 5 degree wall slope cutbacks and slightly chamfered exposed edges to facilitate mating and provide a snap-fastener type joining action. Four such mated pairs along the overlapping edge 14*a* provide edge-to-edge fastening of adjacent base panels 12*a* and 12*b*. Similarly, referring again to FIG. 1, back panels 12*c* and 12*d* are joined at overlapping edge 14*b*.

At the left hand side of FIG. 7 is seen the cross-sectional view of a typical panel breakoff line; a shallow score 34 on the top side and a deeper groove 44 directly on the reverse side enable a panel to be cleanly broken off along any of the score lines 34, seen in FIG. 2, to shorten the panel. As seen cross-section at the right of FIG. 7, the edge 46 thus formed is reinforced by a ribbed configuration.

In assembling a bookrack for a particular bookshelf installation, if the required length exceeds that of a single panel then a base and a back of required total length are each assembled by joining two or more panels 16 together as described in the previous paragraph, and then removing any fractional excess length by snapping off the excess at one of the scored breakoff lines 32. This may be done before or after the bookrack is fully assembled.

In the illustrative embodiment shown in FIG. 1, panel 12*a* is utilized at full original size providing eleven potential partition locations, while panel 12*b* has been shortened to seven potential partition locations by removal of two segments at the right hand end.

Partitions 16 are allocated to the available partition positions as required, and assembled to base 12*a*/12*b* by inserting each bottom pair of tabs 18 into the clearance region 20*a* of corresponding slots 20, then sliding the partitions 16 toward the front until tabs 18 are fully engaged in locking region 20*b* of slots 20, engaging pins 42 in indentations 38.

For illustrative purposes, in FIG. 1 partitions 16 were allocated to the first, second, third and fifth positions of panels 12*a* and 12*c*, and to the first, second, third, fourth, sixth and seventh positions of panels 12*b* and 12*d*.

In assembling the back in the illustrative embodiment shown in FIG. 1, panel 12*c* was joined to panel 12*d*, which was shortened to the same length as panel 12*b* by snapping it off at a breakoff line 34. It should be noted that partial panels 12*b* and 12*d* are not identical, instead they have opposite edge strip configurations.

The back 12*c*/12*d* is then attached to the rear of the assembled partitions 16 by first inserting the rear partition tabs 18 into the clearance regions 20*a* of corresponding retaining slots 20 in back 12*c*/12*d*, then moving back 12*c*/12*d* downward to a locking position fully engaging tabs 18 in locking region 20*b* of slots 20, secured by pins 42 engaging indentations 38. Retention of back 12*c*/12*d* in the locking position is further enhanced by the downward direction of gravitational force on back 12*c*/12*d* positively biasing the full engagement of slot locking regions 20*b* onto corresponding partition tabs 18.

With bookrack 10 thus fully assembled, the abutting 45 degree edges of base 12*a*/12*b* and back 12*c*/12*d* form a mitred joint at corner 36 in FIG. 1.

The assembled bookrack 10 is set into place into its host bookcase as shown in FIG. 1. It will be noted that the base 12*a*/12*b* is made narrower than the shelf 22 of the bookcase, but because the base is made very thin, typically 0.070", a book extending forward onto shelf 22 beyond the front edge of the base 12*a*/12*b* as shown does not appear aesthetically objectionable.

It will also be noted that due to the concealed interlocking partition fastenings provided by tabs 18, slots 20, pins 42 and indentations 38, there are no protrusions of any kind into the cell spaces between adjacent partitions 16.

Very little available shelf space is occupied by the partitions 16 due to their very small thickness, typically made to be 0.060", an important consideration when numerous partitions are utilized.

In the preferred embodiment as shown, a common panel configuration, serving for both base panels and back panels, minimizes tooling and parts inventory costs. Thus, since all partitions are made identical, this entire adaptive bookrack system requires only two different parts. These are readily molded economically from plastic or other composite materials, and could be adapted for fabrication from metal.

Plastic materials such as glass-filled polycarbonate or AB8 are suitable for molding the panels and partitions of this invention. The particular material selected should not only provide the basic material strength to make the bookrack rugged enough to withstand a degree of user abuse such as forcing oversized items between partitions, but it should also provide an optimum degree of compliance, it must be sufficiently stiff to support heavier books without excessive lateral deflection, but not too brittle. These considerations may well result in choice of two different materials, one for the panels and another for the partitions.

A number of options exist to reduce cost by saving material, such as introducing voids in certain areas of the panels and/or partitions, where it is considered functionality would not be impaired. For example material could be removed at the lower rear corner of the partitions, eliminating a circular sector or triangular area. Numerous other variations in partition shape are possible such as various curved outlines and/or non-parallel edges.

The dimensions which have been determined to be preferable for the partitions 16 are 8" by 8" by 0.060" thick, excluding the tabs 18 which are made 1" long, flaring at a 30 degree angle from 0.060" thickness adjacent to the partition to a maximum thickness of about 0.15". The radius of the rounded free corner of partition 16, apparent in FIG. 1, is made to be 2.5".

Panels 12 are made 8" wide to match the partitions 16, and are made 8½" long. When used for extension each panel adds 8" length since the overlap is ½". The eleven pairs of keyed slots 20 defining eleven potential partition locations, are spaced 0.727" apart on centers, with breakoff score lines 34 spaced 2.182" apart, arranged as shown in FIG. 2. As seen in FIG. 7, the panels have a ribbed configuration on their reverse side; panel thickness is 0.070" total including the ribs, and approximately 0.035" in unribbed areas.

It would be entirely feasable to allocate a much greater length to a unit panel, keeping the same spacings, and depend to a much greater extent on utilizing the breakoff capability for obtaining desired ultimate bookrack lengths.

The particular configuration of interlocking fastenings and dimensions shown in this illustrative embodiment have been determined as optimal in the implementation of this invention for many of its anticipated purposes, however it is capable of many other viable and useful embodiments; for example there is the possibility of utilizing alternative partition-to-panel fastening means such as continuous keyways which would engage the full dimension of the partitions along their base and rear edges.

Alternative configurations for the base/back corner 36 in FIG. 1 and FIG. 2 could include interdigitated notches and tabs instead of or supplementary to the 45 degree mitred butt joint shown; such an arrangement would prevent any longitudinal skewing between the base and the back which could tend to distort the partitions.

The scope of this invention is intended to cover all such embodiments, dimensional variations, material substitutions, and other alternative implementations which may become apparent to those of skill without departing form its basic principles and spirit.

What is claimed is:

1. A bookrack, for adding onto an existing bookshelf to provide selectably spaced vertical partitions capable of supporting a variety of reading material such as papers, brochures, magazines and books in an upright position, comprising a thin flat rectangular base, horizontally disposed, having (1) a flat top surface, (2) a front edge, (3) a back edge, (4) two opposed end edges, parallel with each other and (5) disposed along each of a plurality of lines parallel with the end edges, a co-linear pair of elongated partition fastening slots, each having an orthogonal-shaped front half adjoining a rear half having, along its length, an upwardly-narrowing keystone-shaped cross-section;

a plurality of identical thin flat partitions disposed vertically above and engaging selected ones of said partition- fastening slots, each of said partitions having (1) a top edge, (2) a front edge, (3) a base edge, (4) disposed along the base edge, a co-linear pair of downwardly-widening keystone-shaped fastening tabs each configured to removably engage a corresponding one of said partition-fastening slots of said base by first entering the slot through said orthogonal-shaped front half then being moved backward along with said partition to a fully engaged position wherein each of said tabs frictionally engages the keystone-shaped rear half of the corresponding one of said slots, thereby constraining said partition against vertical movement, (5) a back edge disposed so as to become aligned with the back edge of said base when said partition is moved backward to said fully-engaged position, and (6) a co-linear pair of rearwardly-widening keystone-shaped fastening tabs disposed along the back edge; and a thin flat rectangular back, vertically disposed, having (1) a flat front surface, (2) a top edge, (3) a hase edge, (4) two opposed end edges, parallel with each other, and (5) disposed along each of a plurality of lines defining potential partition locations parallel with said end edges. a co-linear pair of elongated partition-fastening slots ach having an orthogonal-shaped lower half adjoining an upper half having, along its lengt, a forwardly-narrowing keystone-shaped cross-section, said slots being configured to removably engage said fastening tabs located on the back edge of said partitions;

whereby a plurality of said partitions thusly attached to said base, may be attached to said back to form a completed bookrack by causing each tab on the back edges of the partitions to enter a corresponding slot of said back through its lower orthogonal-shaped half then moving said back downward to a fully-engaged position wherein each of said tabs frictionally engages the keystone-shaped upper half of the corresponding one of said slots, thereby constraining said back in place against the back edges of said partitions;

wherein said tabs and are configured such that they introduce no protrusions beyond the flat surfaces of said base, back and partitions of an assembled bookrack, thus providing partition fastenings which are in effect concealed so as to maximize space utilization and to render working regions between adjacent partitions entirely free of any protrusions which could otherwise potentially obstruct reading materials placed therein;

said proposed partition locations being configured with sufficiently close spacing to enable satisfactory support of relatively flexible reading material in an upright position, while a user may provide other wider spacings for books and the like by the simple omission of one or more adjacent partitions.

2. The invention as in claim 1 further comprising detent means in said base, said partition and said back, whereby said partition, when moved fully into a locking position, is made to receive additional constraint tending to resist movement of said partition away from said locking position.

3. The invention as in claim 2 wherein said detent means comprises (a) on each of two edges of each said partition between the two tabs thereon, a detent pin having a rounded exposed end, and (b) between each pair of said slots on said bases and said backs, a detent indentation, located so as to engage said pin when said partition is moved fully into said locking position.

4. The invention as in claim 1 wherein said base and said back are made identical with each other.

5. The invention as in claim 1 wherein said base and said back are provided with a plurality of scored lines of reduced material thickness and strength parallel to said side edges whereby said base and said back, and thus said bookrack, may be shortened in length by breaking off an excess portion along one of said scored lines.

6. The invention as in claim 1 wherein said base and said back each comprise a plurality of panels each provided with edge fastening means whereby a plurality of said panels may be tandemed together at overlapping edge joints to lengthen said base and said back to enable assembly of bookracks of increased length.

7. The invention as in claim 6 wherein said edge fastening means comprises, in each of said panels, a quantity of circular plug forms disposed along a first end edge region of said panel, and an equal quantity of circular openings, sized to frictionally engage said plug forms, disposed along a second end edge region opposite said first end edge region of said panel, said second end edge region being offset away from the face side of said panel;

whereby a plurality of said panels are enabled to be joined together end-to-end by overlapping adjacent end edge regions and engaging said plug forms of one or more of said panels into corresponding circular openings of an adjacent one of said panels to form a substantially continuous surface on the side of said panels intended for partition location.

8. For adding onto an existing bookshelf to provide vertical partitions, at user-select spacings, capable of supporting a variety of intermixed hard-cover, soft-cover and unbound reading material in an upright position, a bookrack, which can be easily assembled to any required length from flat thin plastic parts molded in only two standardized configurations, by an unskilled person without need for tools or additional fastening parts, comprising;

a plurality of identical thin, flat partitions provided with fastening means disposed along two adjacent edges, a base and a back each formed by at least one standardized panel provided with edge-joining means disposed along two opposite end edges whereby it can be extended in length by being joined along an end edge to another identical panel, each panel being provided with an array of partition fastening means disposed along equally spaced lines defining potential partition locations parallel with said end edges, and each panel being provided with a plurality of scored breakoff lines located midway between nearest adjacent pairs of said partition locations, whereby a panel may be reduced in length by breaking off a surplus portion, whereby a bookrack of designated length and partition spacing may be assembled by joining together a sufficient number of panels by said edge-joining means to form a base of at least the required length, fastening partitions to the base at user-selected partition locations, similarly forming a back having the same length as the base, fastening the back to rear edges of said partitions by said fastening means at corresponding partition locations, and then, if necessary, reducing the finished bookrack length by breaking off any surplus at said breakoff lines.

9. The invention as in claim 8 wherein said fastening means comprise;

a co-linear pair of keystone-shaped fastening tabs, each flared to an increased edge thickness, disposed along each of two adjacent edges of each of said partitions, and a corresponding co-linear pair of slots disposed along each partition location line of each of said panels, each slot having (a) an orthogonally-shaped clearance region for accepting a corresponding one of said fastening tabs, and (b) an adjoining keystone-shaped locking region into which said tab may be shifted and thus made captive, whereby said partitions may be fastened to said base at user-selected partition locations, and said partitions may be fastened to said back at corresponding partition locations.

10. The invention as in claim 9 further comprising interlock detent means comprising;

(a) on each of two edges of each said partition between the two tabs thereon, a detent pin having a rounded exposed end, and (b) between each pair of said slots on said bases and said backs, a detent indentation, located so as to engage said pin when said partition is moved fully into said locking position.

whereby said partition, when moved fully into said locking position, is urged to resist movement away from said locking position.

11. The invention as in claim 8 wherein said edge-fastening means comprises, in each of said panels, a quantity of circular plug forms disposed along a first end edge region of said panel, and an equal quantity of circular openings, correspondingly disposed along a second end edge region opposite said first end edge region of said panel, said second end edge region being offset away from the face side of said panel.

said buttons and said openings being sized and shaped to removably engage each other in a snap fastener manner;

whereby a plurality of said panels are enabled to be joined together end-to-end by overlapping adjacent end edge regions and engaging said plug forms of one or more of said panels into corresponding circular openings of an adjacent one of said panels to form a substantially continuous surface on said panels, on one side intended for partition location.

12. A plurality of identical thin flat rectangular panels configured to serve as the basic "building blocks" from which, in co-operation with a plurality of partitions, bookracks of various and unlimited lengths, and of various intermixed partition spacings may be readily field-assembled by unskilled personnel without need for tools or additional fastening parts, each panel comprising;

a first end edge, offset from the panel away from its face side, provided with extension fastening means, a second end edge, opposite and parallel with said first end edge, provided with corresponding extension fastening means;

whereby said panel may be extended by attachment at an end edge to an overlapping adjacent end edge of a second one of said panels, partition fastening means arranged in an array, disposed on equally spaced lines parallel with said end edges, defining potential partition locations, said fastening means comprising co-linear pairs of slots each having an orthogonal-shaped portion and an adjoining keystone-shaped portion, adapted to removably engage corresponding pairs of keystone-shaped tabs on said partitions.

a plurality of scored breakoff lines of reduced panel thickness, equally spaced and disposed midway between nearby potential partition locations, whereby said panel may be shortened by breaking off a selected portion, whereby a quantity of said panels joined together to form a base and the same quantity of said panels joined together to form a back, may be shortened in length to obtain a desired bookrack length by utilizing said breakoff lines as required, and whereby a plurality of partitions, provided with corresponding attachment means, may be located and attached to said base and said back at selected ones of said partition locations, forming a completed bookrack in accordance with this invention.

13. The method of assembling a bookrack of desired length and partition spacing, utilizing a unique bookrack assembly system requiring only two "building blocks": a panel configuration and a partition configuration; comprising the steps of (a) joining a number of said panels together by integral edge fastening means provided, to form a bookcase base of sufficient total length, (b) joining the same number of said panels together in the same manner to form a back equal in length to the base, (c) removing surplus portions of said base and said back by breaking off the panels at scored breakoff line provided to obtain the required final bookrack length, (d) fastening the bottom edges of a desired number of partitions in selected locations chosen from an array of partition locations provided on the base panels, utilizing partition fastening means provided on the base panels, and (e) fastening the rear edges of said partitions at corresponding partition locations in an array of partition locations provided on the back panels, utilizing partition fastening means provided on the back panels.

* * * * *